US006509103B1

(12) United States Patent
Hüffer et al.

(10) Patent No.: US 6,509,103 B1
(45) Date of Patent: Jan. 21, 2003

(54) METHOD FOR COATING REACTORS FOR HIGH PRESSURE POLYMERIZATION OF 1-OLEFINS

(76) Inventors: Stephan Hüffer, Luitpoldstr. 19, 67063 Ludwigshafen (DE); Andreas Deckers, Schulstr. 11, 55234 Flomborn (DE); Wilhelm Weber, Mandelbergstr. 40, 67435 Neustadt (DE); Roger Klimesch, Georg-Fröba-Str. 43, 64665 Alsbach-Hähnlein (DE); Dieter Littmann, Neckarpromenade 36, 68167 Mannheim (DE); Jürgen Sturm, Schönbrückstr. 28, 67376 Harthausen (DE); Götz Lerch, Rosenwörthstr. 25, 67071 Ludwigshafen (DE)

( * ) Notice: Subject to any disclaimer, the term of this patent is extended or adjusted under 35 U.S.C. 154(b) by 0 days.

(21) Appl. No.: 09/869,147

(22) PCT Filed: Dec. 24, 1999

(86) PCT No.: PCT/EP99/10372

§ 371 (c)(1),
(2), (4) Date: Jun. 26, 2001

(87) PCT Pub. No.: WO00/40775

PCT Pub. Date: Jul. 13, 2000

(30) Foreign Application Priority Data

Dec. 30, 1998 (DE) ..... 198 60 526

(51) Int. Cl.[7] ..... B05D 7/22; B05D 1/18; B05D 1/36; B32B 15/00

(52) U.S. Cl. ..... 428/457; 428/624; 428/680; 427/437; 427/438; 427/443.1; 427/239; 427/404; 427/405; 427/419.1

(58) Field of Search ..... 427/436, 437, 427/438, 443.1, 404, 405, 419.1, 239; 428/624, 680, 457

(56) References Cited

U.S. PATENT DOCUMENTS

| | | | | |
|---|---|---|---|---|
| 4,344,993 A | * | 8/1982 | Schmidt et al. | 206/524.3 |
| 6,335,402 B1 | * | 1/2002 | Mihan et al. | 422/137 |

FOREIGN PATENT DOCUMENTS

| | | |
|---|---|---|
| DE | 40 10 271 | 10/1991 |
| EP | 567 818 | 11/1993 |
| EP | 737 759 | 10/1996 |
| WO | 97/49771 | 12/1997 |

OTHER PUBLICATIONS

J. of Mat.Sci, 1996 Zhang et al., 5191–5198, 1996.
Ullmanns Ency.Band 19, 169–173 (1980).
Chemische Reaktionstechnik, Fitzer et al., 152–157, 1982.
Polymer Mater.Sci.and Eng. Proceeding of the ACS Div. of Poly.Materials Sci and Eng.1990, 62, 259–263.
Riedel:Funktionelle Vernickelung, 1989, 231–236.

* cited by examiner

*Primary Examiner*—Michael Barr

(57) ABSTRACT

A process for coating a reactor, which comprises depositing a metal layer or a metal/polymer dispersion layer on the internal surface of the reactor in an electroless manner by bringing the surfaces into contact with a metal electrolyte solution which, besides the metal electrolyte, comprises a reducing agent and optionally a halogenated polymer to be deposited in dispersed form.

16 Claims, No Drawings

METHOD FOR COATING REACTORS FOR HIGH PRESSURE POLYMERIZATION OF 1-OLEFINS

The present invention relates to a process for coating reactors for the high-pressure polymerization of 1-olefins. This invention furthermore relates to reactors and high-pressure reactor plants for the polymerization or copolymerization of 1-olefins, in particular ethylene, which include the reactors coated in accordance with the invention, and to a process for the preparation of ethylene homopolymers and copolymers in the reactors according to the invention.

The preparation of homopolymers and copolymers of ethylene at high pressure is a process which is carried out industrially on a large scale. In these processes, pressures above 500 bar and temperatures of 150° C. or above are used. The process is generally carried out in high-pressure autoclaves or in tubular reactors. High-pressure autoclaves are known in compact or elongate embodiments. The known tubular reactors (Ullmanns Encyclopädie der technischen Chemie, Volume 19, p. 169 and p. 173 ff (1980), Verlag Chemie, Weinheim, Deerfield Beach, Basle) are distinguished by simple handling and low maintenance and are advantageous compared with stirred autoclaves. The conversions which can be achieved in the above-mentioned apparatuses are limited.

In order to increase the capacity of the available apparatuses, the aim is to achieve the highest possible conversions. However, limiting factors are the polymerization temperature and polymerization pressure, which have a specific upper limit depending on the product type. For low-density LDPE waxes and LDPE polymers, this upper limit is about 330° C.; above this, spontaneous decomposition of ethylene may occur. Below a temperature of 150° C., heat dissipation problems may occur. Further, the pressure loss which occurs is a limiting factor; this pressure loss increases with falling temperature.

A crucial factor for the operation of a tubular reactor for the polymerization of ethylene is good heat dissipation. This heat dissipation is preferably achieved by jacket cooling, where a cooling medium, generally water, is passed through a cooling circuit. The temperature of the cooling medium is of great importance. At cooling medium temperatures below 150° C., a laminar layer of polyethylene, which can act as insulator and drastically reduce the heat dissipation, can form. If the temperature of the cooling medium is selected to be too high, the temperature difference between the reaction medium and the cooling medium is too low, which likewise results in unsatisfactory heat transfer coefficients (cf., for example, E. Fitzer, W. Fritz, Chemische Reaktionstechnik, 2$^{nd}$ Edition, page 152 ff., Springer Verlag Heidelberg, 1982).

In practice, however, a slow-flowing layer of polyethylene is also observed at temperatures above 150° C., resulting in a reduction in heat dissipation. One method of preventing the formation of this layer is so-called "stimulation" (EP-B 0 567 818, p. 3, line 6 ff.) Through periodic pressure reduction, the flow rate is drastically increased and the laminar layers briefly eliminated. However, the periodic reduction in pressure means that the average pressure during operation is reduced, which reduces the density of the ethylene and thus reduces the conversion and molecular weight of the product. In addition, the periodic reduction in pressure causes a considerable mechanical load in the apparatus, which results in increased repair costs and thus produces economic disadvantages.

The formation of laminar interfacial layers in tubular reactors or even stirred autoclaves for the polymerization of ethylene also has adverse consequences for the quality of the ethylene polymers. The material having a significantly longer residence time in the reactors is usually of high molecular weight, which is evident in macroscopic terms from the formation of so-called fisheyes. However, the material containing fisheyes has less good mechanical properties since nominal breaking points, where material failure occurs, form in the material, and the optical impression is also disadvantageous.

Attempts to coat the tubes with PTFE (polytetrafluoroethylene) have not resulted in success. Although PTFE is the obvious choice as a heat-resistant, polyethylene-incompatible material, it does, however, act as insulator, even in thin layers, and impairs heat transfer. Similar problems are also observed in processes which include the application of silane monolayers to the surface to be protected (Polymer Mater. Sci. and Engineering, proceedings of the ACS Division of Polymeric Materials Science and Engineering (1990), Volume 62, pages 259 to 263).

It is an object of the present invention

- to provide a process which enables the conversion in reactors, in particular for the high-pressure polymerization of ethylene, to be improved, where this process should be based on coating of the reactors;
- to provide correspondingly treated reactors,
- to utilize these reactors for the construction of high-pressure reactors, and
- to prepare polymers of 1-olefins in the reactors according to the invention.

We have found that this object is achieved by a process for coating a reactor for the high-pressure polymerization of 1-olefins, which comprises depositing a metal layer or a metal/polymer dispersion layer on the internal surface of a reactor in an electroless manner by bringing the surfaces into contact with a metal electrolyte solution which, besides the metal electrolyte, comprises a reducing agent and optionally a halogenated polymer to be deposited in dispersed form, by reactors coated in accordance with the invention for the high-pressure polymerization of ethylene, by the use of the reactors according to the invention for the high-pressure polymerization of ethylene, and by a process for the high-pressure polymerization of ethylene.

The reactors coated with an anti-adhesive metal coating or metal/polymer dispersion layer enable significantly improved conversion compared with uncoated reactors.

This solution according to the invention is based on a process for the electroless chemical deposition of metal layers or metal/polymer dispersion phases which is known per se (W. Riedel: Funktionelle Vernickelung, Verlag Eugen Leize, Saulgau, 1989, pages 231 to 236, ISBN 3-750480-044-x). The deposition of the metal layer or the metal/polymer dispersion phases serves for coating of the inside walls of the high-pressure reactor, which is known per se. The metal layer to be deposited by the process according to the invention comprises an alloy or alloy-like mixed phase comprising a metal and at least one further element. The metal/polymer dispersion phases according to the invention additionally comprise a polymer, for the purposes of the present invention a halogenated polymer, which is dispersed in the metal layer. The metal alloy is preferably a metal/boron alloy or a metal/phosphorus alloy having a boron or phosphorus content of from 0.5 to 15% by weight.

A particularly preferred embodiment of the coatings according to the invention involves so-called "chemical nickel systems", i.e. phosphorus-containing nickel alloys having a phosphorus content of from 0.5 to 15% by weight; very particular preference is given to nickel alloys having a high phosphorus content of from 5 to 12% by weight.

In contrast to electrodeposition, the requisite electrons in chemical or autocatalytic deposition of the metal/phosphorus or metal/boron are not provided by an external current source, but instead are generated by chemical reaction in the electrolyte itself (oxidation of a reducing agent). The coating is carried out, for example, by dipping the workpiece into a metal electrolyte solution which has been mixed in advance with a stabilized polymer dispersion.

The metal electrolyte solutions used are usually commercially available or freshly prepared metal electrolyte solutions to which, in addition to the electrolyte, the following components are also added: a reducing agent, such as a hypophosphite or borohydride (for example $NaBH_4$), a buffer mixture for setting the pH, an alkali metal fluoride, for example NaF, KF or LiF, carboxylic acids and a deposition moderator, for example $Pb^{2+}$. The reducing agent here is selected so that the corresponding element to be incorporated is already present in the reducing agent.

Particular preference is given to commercially available nickel electrolyte solutions which comprise $Ni^{2+}$, hypophosphite, carboxylic acids and fluoride and, if desired, deposition moderators, such as $Pb^{2+}$. Such solutions are marketed, for example, by Riedel Galvano- and Filtertechnik GmbH, Halle, Westphalia, and Atotech Deutschland GmbH, Berlin. Particular preference is given to solutions which have a pH of about 5 and comprise about 27 g/l of $NiSO_4.6\ H_2O$ and about 21 g/l of $NaH_2PO_2.H_2O$ with a PTFE content of from 1 to 25 g/l.

The optional halogenated polymer in the process according to the invention is preferably fluorinated. Examples of suitable fluorinated polymers are polytetrafluoroethylene, perfluoroalkoxy polymers (PFAs, for example containing $C_1$- to $C_8$-alkoxy units), copolymers of tetrafluoroethylene and perfluoroalkyl vinyl ethers, for example perfluorovinyl propyl ether. Particular preference is given to polytetrafluoroethylene (PTFE) and perfluoroalkoxy polymers (PFAS, in accordance with DIN 7728, Part 1, January 1988).

The form used can preferably be commercially available polytetrafluoroethylene dispersions (PTFE dispersions). Preference is given to PTFE dispersions having a solids content of from 35 to 60% by weight and a mean particle diameter of from 0.05 to 1.2 $\mu$m, in particular from 0.1 to 0.3 $\mu$m. Preference is given to spherical particles since the use of spherical particles results in very homogeneous composite layers. An advantageous factor in the use of spherical particles is faster layer growth and better, in particular longer thermal stability of the baths, offering economic advantages. This is particularly evident in comparison with systems using irregular polymer particles obtained by grinding the corresponding polymer. In addition, the dispersions used may comprise a nonionic detergent (for example polyglycols, alkylphenol ethoxylate or optionally mixtures of said substances, from 80 to 120 g of neutral detergent per liter) or an ionic detergent (for example alkyl- and haloalkylsulfonates, alkylbenzenesulfonates, alkylphenol ether sulfates, tetraalkylammonium salts or optionally mixtures of said substances, from 15 to 60 g of ionic detergent per liter) for stabilization of the dispersion.

The coating is carried out at slightly elevated temperature, but this must not be so high that destabilization of the dispersion occurs. Temperatures of from 40 to 95° C. have proven suitable. Preference is given to temperatures of from 80 to 91° C. and particularly preferably 88° C.

Deposition rates of from 1 to 15 $\mu$m/h have proven useful. The deposition rate can be affected as follows by the composition of the dip baths:

Higher temperatures increase the deposition rate, there being a maximum temperature which is limited, for example, by the stability of any polymer dispersion added. Lower temperatures reduce the deposition rate.

Higher electrolyte concentrations increase the deposition rate and lower ones decrease the deposition rate; concentrations of from 1 g/l to 20 g/l of $Ni^{2+}$ being appropriate, and concentrations of from 4 g/l to 10 g/l being preferred; for $Cu^{2+}$, from 1 g/l to 50 g/l are appropriate.

Higher concentrations of reducing agent likewise increase the deposition rate;

An increase in the pH allows the deposition rate to be increased. A pH of between 3 and 6, particularly preferably between 4 and 5.5, is preferably set.

Addition of activators, for example alkali metal fluorides, for example NaF or KF, increases the deposition rate.

The polymer content of the dispersion coating is affected principally by the amount of added polymer dispersion and the choice of detergents. Concentration of the polymer plays a major role here; high polymer concentrations of the dip baths result in a disproportionately high polymer content in the metal/phosphorus polymer dispersion layer or metal/boron/polymer dispersion layer.

It has been found that the surfaces treated in accordance with the invention enable good heat transfer although the coatings can have a not inconsiderable thickness of from 1 to 100 $\mu$m. Preferred thicknesses are from 3 to 20 $\mu$m, in particular from 5 to 16 $\mu$m. The polymer content of the dispersion coating is from 5 to 30% by volume, preferably from 15 to 25% by volume, particularly preferably from 19 to 21% by volume. The surfaces treated in accordance with the invention furthermore have excellent durability.

The dipping operation is preferably followed by conditioning at from 200 to 400° , especially at from 315 to 380° C. The conditioning duration is generally from 5 minutes to 3 hours, preferably from 35 to 60 minutes.

The present invention furthermore relates to a process for the production of a coated reactor which has a particularly strongly adhering, durable and heat-resistant coating and therefore achieves the object according to the invention in a particular manner.

This process comprises additionally applying a metal/phosphorus layer with a thickness of from 1 to 15 $\mu$m, preferably from 1 to 5 $\mu$m, by electroless chemical deposition before application of the metal/polymer dispersion layer.

The electroless chemical application of a metal/phosphorus layer with a thickness of from 1 to 15 $\mu$m for improving the adhesion is in turn carried out by means of metal electrolyte baths, but to which in this case no stabilizing polymer dispersion is added. Conditioning is preferably omitted at this point in time, since this generally has an adverse effect on the adhesion of the following metal/polymer dispersion layer. After deposition of the metal/phosphorus layer, the workpiece is introduced into a second dip bath which, besides the metal electrolyte, also comprises a stabilized polymer dispersion. The metal/polymer dispersion layer forms during this operation.

Conditioning at from 100 to 450° C., in particular at from 315 to 400° C., is preferably carried out subsequently. The conditioning duration is generally from 5 minutes to 3 hours, preferably from 35 to 45 minutes.

The reactors used for the high-pressure polymerization of ethylene are, as stated at the outset, high-pressure autoclaves or alternatively tubular reactors, tubular reactors being preferred. Tube-shaped reactors can be coated particularly well by a preferred variant of the process according to the invention by pumping the metal electrolyte solution or the metal electrolyte/polymer dispersion mixture through the reactor to be coated.

In the case of an embodiment using tube-shaped reactors, the tubes coated according to the invention can easily be installed in polymerization plants for high-pressure polymerization, where they replace uncoated tubes.

The polymerization of ethylene in the plants according to the invention which contain the tubes according to the invention is usually carried out at pressures of from 400 to 6000 bar, preferably from 500 to 5000 bar and particularly preferably from 1000 to 3500 bar.

The reaction temperature is from 150 to 450° C., preferably from 160 to 250° C.

A particularly suitable monomer in the polymerization process according to the invention is ethylene. It is also possible to prepare copolymers with ethylene, where in principle all olefins which can be copolymerized with ethylene by means of free radicals are suitable as comonomers. Preference is given to

- 1-olefins, such as propylene, 1-butene, 1-pentene, 1-hexene, 1-octene and 1-decene,
- acrylates, such as acrylic acid, methyl acrylate, ethyl acrylate, n-butyl acrylate or tert-butyl acrylate;
- methacrylic acid, methyl methacrylate, ethyl methacrylate, n-butyl methacrylate or tert-butyl methacrylate;
- vinyl carboxylates, where vinyl acetate is particularly preferred,
- unsaturated dicarboxylic acids, particularly preferably maleic acid,
- unsaturated dicarboxylic acid derivatives, particularly preferably maleic anhydride and maleic acid alkylimides, for example maleic acid methylimide.

Suitable molecular weight regulators are hydrogen, aliphatic aldehydes, ketones, CH-acidic compounds, such as mercaptans or alcohols, olefins and alkanes.

The polymerization can be initiated using oxygen-containing gases, for example air, but also using organic peroxo compounds or using organic azo compounds, for example AIBN (azobisiso-butyronitrile). Preference is given to organic peroxo compounds, particular preference being given to benzoyl peroxide and di-tert-butyl peroxide.

The ethylene polymers prepared by the process according to the invention may have very different molar masses, depending on the reaction conditions. Preferred molar masses $M_W$ are between 500 and 600,000 g.

A particularly advantageous feature of the ethylene polymers prepared in accordance with the invention is their low fisheye count, which is usually specified in the form of a fisheye score, where a low fisheye score usually corresponds to a low fisheye count. The polymers prepared in accordance with the invention are particularly suitable for the production of moldings and sheet-like structures, such as films or bags.

The invention will be explained with reference to a working example.

WORKING EXAMPLE

1. Chemical Nickel System

The uninstalled reactor tube (length 150 m, diameter 15 mm) was brought into contact with an aqueous nickel salt solution at a temperature of 88° C., the solution having the following composition: 27 g/l of $NiSO_4.6\ H_2O$, 21 g/l of $NaH_2PO_2.2\ H_2O$, lactic acid $CH_3CHOHCO_2H$ 20 g/l, propionic acid $C_2H_5CO_2H$ 3 g/l, Na citrate 5 g/l, NaF 1 g/l (note: chemical electroless nickel electrolyte solutions having this and other concentrations are commercially available, for example from Riedel Galvano- and Filtertechnik GmbH, Halle, Westphalia; or from Atotech Deutschland GmbH, Berlin)). The pH was 4.8. In order to achieve uniform layer thicknesses, the solution was pumped through the tube at a flow rate of 0.1 m/s. At a deposition rate of 12 μm/h, the process was complete after 75 minutes. The layer thickness achieved was 16 μm. The coated tube was subsequently rinsed with water, dried and conditioned at 400° C. for one hour.

2. Nickel/PTFE System

The production was carried out in 2 steps. Firstly, the uninstalled reactor tube (length 150 m, diameter 15 mm) was brought into a contact with an aqueous nickel salt solution at a temperature of 88° C., the solution having the following composition: 27 g/l of $NiSO_4.6\ H_2O$, 21 g/l $NaH_2PO_2.2\ H_2O$,20 g/l of lactic acid $CH_3CHOHCO_2H$, 3 g/l of propionic acid $C_2H_5CO_2H$, 5 g/l of Na citrate, 1 g/l of NaF. The pH was 4.8. In order to achieve uniform layer thicknesses, the solution was pumped through the tube at a flow rate of 0.1 m/s. At a deposition rate of 12 μ/h, 25 minutes were needed in order to obtain the achieved layer thickness of 5 μm.

This step was not followed by rinsing.

1% by volume of a PTFE dispersion having a density of 1.5 g/ml was subsequently additionally added to the nickel salt solution. This PTFE dispersion had a solids content of 50% by weight. At a deposition rate of 8 μm/h, the process was complete in two hours (layer thickness 16 μm). The coated tube was rinsed with water, dried and conditioned at 350° C. for one hour.

3. Polymerization Examples 1 to 3

The polymerization was carried out in a reactor with a total length of 400 m. A detailed description of the reactor and the polymerization conditions is given in DE-A 40 10 271. The reactor was divided into 3 zones; at the beginning of each 45 zone, initiation was carried out with peroxide solution. The dimensions of the zones are shown in Table 1.

The polymerization was carried out at a pressure of 3000 bar. The molecular weight regulator used was propionaldehyde. The temperature of the cooling medium water was 200° C. The maximum reaction temperatures were—as usual in high-pressure tubular reactors—adjusted by metering in the corresponding amount of peroxide solution.

The fisheye score was determined by means of an automatic in-line measurement device (Brabender, Duisburg, "Autograder"). To this end, a small part of the polymer melt was shaped at 200° C. to give a film having a thickness of about 0.5 mm by means of a slot die with a width of about 10 cm. By means of a video camera and an automatic counting device, the number of fisheyes was determined. Classification in the fisheye score was then carried out on the basis of the number.

TABLE 1

Dimensions of the reaction zones of the experimental reactor

| Zone No. | 1 | 2 | 3 |
|---|---|---|---|
| Length [m] | 150 | 150 | 100 |
| Diameter [mm] | 15 | 25 | 25 |

In each case, only zone No. 1 was coated in accordance with the invention, and the corresponding experiments were carried out. The results are shown in Table 2. It is expected that coating of the other zones will result in a further increase in the conversion.

TABLE 2

Polymerizations in variously coated reactors

| Example No. | 1 | 2 | 3 (Comparative Example) |
|---|---|---|---|
| Coating Zone 1 | Nickel | Nickel/PTFE | None |
| $T_{max}$ 1 [° C.] | 280 | 280 | 280 |
| $T_{min}$ 1 [° C.] | 223 | 219 | 235 |
| $T_{max}$ 2 [° C.] | 280 | 280 | 280 |
| $T_{max}$ 3 [° C.] | 280 | 278 | 279 |
| Product density (g/ml) | 0.9229 | 0.9230 | 0.9225 |
| MFI [g/min] | 0.8 | 0.79 | 0.8 |
| Conversion [%] | 27.9 | 28.3 | 26.3 |
| Fisheye score | 2.5 | 2 | 3 |

We claim:

1. A process for coating a reactor for the polymerization of 1-olefins at pressures of from 400 to 6000 bar, which comprises depositing a metal layer or a metal/polymer dispersion layer on the internal surface of the reactor in an electroless manner by bringing the surfaces into contact with a metal electrolyte solution which, besides the metal electrolyte, includes a reducing agent and optionally a halogenated polymer to be deposited in dispersed form.

2. A process as claimed in claim 1, wherein the metal electrolyte used is a nickel or copper electrolyte solution, and the reducing agent used is a hypophosphite or a borohydride.

3. A process as claimed in claim 1, wherein a dispersion of a halogenated polymer is added to the metal electrolyte solution.

4. A process as claimed in claim 1, wherein the metal electrolyte employed is a nickel salt solution, which is reduced in situ using an alkali metal hypophosphite and to which a polytetrafluoroethylene dispersion is added as halogenated polymer.

5. A process as claimed in claim 1, wherein a halogenated polymer comprising spherical particles having a mean diameter of from 0.1 to 1.0 $\mu$m is used.

6. A process as claimed in claim 1, wherein a halogenated polymer comprising spherical particles having a mean diameter of from 0.1 to 0.3 $\mu$m is used.

7. A process as claimed in claim 1, wherein a nickel/phosphorus/polytetrafluoroethylene layer having a thickness of from 1 to 100 $\mu$m is deposited.

8. A process as claimed in claim 1, wherein a nickel/phosphorus/polytetrafluoroethylene layer having a thickness of from 3 to 20 $\mu$m is deposited.

9. A process as claimed in claim 1, wherein a nickel/phosphorus/polytetrafluoroethylene layer having a thickness of from 5 to 16 $\mu$m is deposited.

10. A process as claimed in claim 1, wherein firstly an additional metal/phosphorus layer having a thickness of from 1 to 15 $\mu$m and then a metal/phosphorus/polymer dispersion layer are deposited on the inside of the reactor in an electroless manner.

11. A process as defined in claim 10, wherein the additional metal/phosphorus layer deposited is a nickel/phosphorus layer, a copper/phosphorus layer, a nickel/boron layer or a copper/boron layer having a thickness of from 1 to 5 $\mu$m.

12. A reactor coated on the inside, obtainable by a process as claimed in claim 1.

13. A reactor coated on the inside as defined in claim 12, wherein the reactor is tubular and is coated with a metal/phosphorus/polymer dispersion layer having a thickness of from 3 to 20 $\mu$m.

14. A reactor as claimed in claim 12, which carries a nickel/phosphorus layer having a thickness of from 1 to 15 $\mu$m below the nickel/phosphorus/polytetrafluoroethylene dispersion layer having a thickness of from 3 to 20 $\mu$m.

15. A process for the continuous polymerization or copolymerization of ethylene at pressures of from 500 to 6000 bar and temperatures of from 150 to 450° C., which comprises carrying out the polymerization in a high-pressure reactor as claimed in claim 12.

16. A process as defined in claim 15, wherein the reactor is tubular.

* * * * *